United States Patent [19]

Adams et al.

[11] 4,416,183

[45] Nov. 22, 1983

[54] ROCKET RETENTION AND IGNITION SYSTEM

[76] Inventors: Robert W. Adams, 11404 Farmland Dr., Rockville, Md. 20852; Charles R. Donohoe, 15309 Basswood Ct., Rockville, Md. 20853

[21] Appl. No.: 287,643

[22] Filed: Jul. 28, 1981

[51] Int. Cl.[3] ..... F41F 3/06

[52] U.S. Cl. ..... 89/1.807; 89/1.813; 89/1.816

[58] Field of Search ..... 89/1.806, 1.807, 1.812, 89/1.813, 1.814

[56] References Cited

U.S. PATENT DOCUMENTS

| | | | |
|---|---|---|---|
| 2,448,962 | 9/1948 | D'Ardenne | 89/1.807 |
| 2,496,316 | 2/1950 | Skinner et al. | 89/1.807 |
| 2,712,270 | 7/1955 | Green | 89/1.807 |
| 2,751,818 | 6/1956 | Bonnett | 89/1.807 |
| 2,764,066 | 9/1956 | Doak et al. | 89/1.807 |
| 2,938,431 | 5/1960 | Dixon | 89/1.807 |
| 3,059,542 | 10/1962 | Manz et al. | 89/1.807 |
| 3,059,543 | 10/1962 | Manz et al. | 89/1.807 |
| 3,094,896 | 6/1963 | Carson, Jr. et al. | 89/1.806 |
| 3,315,565 | 4/1967 | Nash | 89/1.807 |
| 3,412,640 | 11/1968 | Nash | 89/1.806 |
| 3,435,726 | 4/1969 | Gabler | 89/1.807 |
| 3,608,423 | 9/1971 | Nash | 89/1.807 |
| 3,721,155 | 3/1973 | Stauff et al. | 89/1.807 |
| 3,958,490 | 5/1976 | Zellmer et al. | 89/1.807 |
| 4,007,660 | 2/1977 | Smith et al. | 89/1.807 |
| 4,038,902 | 8/1977 | Welsh | 89/1.807 |
| 4,080,868 | 3/1978 | Matthews | 89/1.806 |

*Primary Examiner*—David H. Brown

*Attorney, Agent, or Firm*—Glenn J. Perry

[57] ABSTRACT

A rocket retention and ignition system including in one embodiment, a linearly movable rocket retaining and firing pin biased by a spring to an extended position within the launch cavity of a rocket launcher tube. An electrically actuable solenoid, upon the application of an actuating signal pulls the pin to a withdrawn position so that its retaining end is flush with the inside wall of the launcher tube. A firing contact on the pin, designed to mate with a similar firing contact within the rocket, conducts a firing signal for igniting the rocket. An electronic control system generates a firing signal on a line electrically coupled to the pin firing contact and a solenoid actuating signal coupled to the solenoid with appropriate timing so that the firing signal is applied followed after a predetermined interval of time by the solenoid signal. In another embodiment, there are provided separate firing and retaining pins.

27 Claims, 6 Drawing Figures

102
214
60 Hz OSCILLATOR
216
÷ 10 COUNTER
218
÷ 6 COUNTER
220
÷ 10 COUNTER
8 7 6 5 4 3 2 1 0
222
÷ 6 COUNTER
100
104
204
200
206
S
R
Q
224
226
228
240
230
AMP
56
FIRING LOAD 116
208
S
n
Q
210
AMP.
212
POWER SUPPLY GATE
POWER TURN ON
242
244
42
44
50
58
136
LOAD CONTROL

ROCKET RETENTION AND IGNITION SYSTEM

BACKGROUND OF THE INVENTION

1. Field of the Invention

This invention pertains in general to rocket launchers. More specifically, it provides a rocket retention and ignition system for use in a rocket launcher.

2. Description of the Prior Art

A number of known retention and ignition systems such as those shown in U.S. Pat. Nos. 3,315,565—Nash; 3,412,640—Nash; and 3,608,423—Nash, the teachings of which are hereby incorporated by reference, make use of detent or latch retention mechanisms and ignition mechanisms that permanently protrude into the interior of a launcher tube through holes bored in a side wall of the tube. Such mechanisms are directly in the path of the exhaust gases of the rocket and become corroded. Furthermore, such systems are unsatisfactory in that the retention and ignition mechanism requires rather large holes or slots in the launcher tube walls. These large holes or slots allow rocket exhaust to come into contact with the retention and ignition mechanisms which become corroded. The problem is even further accentuated because the holes or slots become eroded under the action of rocket exhaust.

Moreover, these retention and ignition mechanisms that protrude into the launcher tube may interfere with the reproducibility of the rocket release conditions since the mechanisms can be damaged during loading as, for example, when rockets are jammed against such mechanisms too hard. In this regard, the reproducibility of rocket release conditions is important to enhance the accuracy of the rockets being launched. This is true whether the rocket launcher has just one launch tube or more.

Other systems, such as shown in U.S. Pat. Nos. 2,938,431—Dixon; and 3,958,490—Zellmer et al, the teachings of which are hereby incorporated by reference, are unsatisfactory due to the disclosed pivotal (rotatable) retraction method necessitating such large holes or slots in the tube walls, thereby resulting in the aforesaid corrosion and erosion problems. The effect of this corrosion and erosion is important since both patents disclose rocket release only after the rocket thrust attains a force sufficient to overcome the spring or coil detent mechanism. Accordingly, such corrosion and erosion may interfere with the reproducibility of the rocket release conditions. Furthermore, such spring or coil mechanisms require a lot of maintenance which is undesirable.

Other known systems have utilized shear pins rather than detents or latches to retain a rocket loaded into the tube. The shear pins of a rocket engage a shear pin ring of the rocket launcher so that the shearing force of the shear pin determines the rocket release load. Such systems, however, suffer the additional operational disadvantage of requiring individual correct orientation of the rockets and/or its electrical connections, thereby increasing both the loading time and the incidence nonfunctioning or malfunctioning of the rocket ignition systems.

A more recent development is shown in U.S. Pat. No. 4,007,660—Smith et al, the teachings of which are also incorporated herein by reference. This Smith et al patent discloses a rear loading rocket launcher system. However, the rear loading system requires a special rear support (i.e. a second rear bulkhead) that increases the time required for loading the launcher since such support means must be removed and then replaced during loading. Furthermore, the firing coating is positioned so as to be directly in the path of the exhaust of the rocket. As a result, the firing contact may be corroded and/or melted by the exhaust.

SUMMARY OF THE INVENTION

Therefore, a primary object of the present invention is to provide a rocket retention and ignition system for use in a rocket launcher having one or more launcher tubes that retracts so as to not be directly within the blast of the rocket exhaust and that retracts in such a manner that the mechanism is shielded from exhaust gases within the launcher. In addition, it is an object of the present invention to provide a more simple and reliable structure that avoids the need to utilize a spring or coil release system that is actuated when the thrust of the rocket overcomes such release mechanism. Therefore, the present invention provides a rocket launcher that is easier to clean and maintain since, for example, its retention and ignition means are not corroded or melted by the rocket exhaust so as to require more frequent cleaning or replacement.

It is another object of the present invention to provide a retention and ignition system that permits a decreased rocket loading time as compared to systems requiring special orientation to ensure electrical contact or to systems having an additional rear support means that must be removed and then replaced during loading.

A further object of the present invention is to provide a retention and ignition system that will not be damaged during rocket loading. In this regard, rockets being loaded into conventional launchers may be slid into the tube so forcefully as to damage retention and/or electrical contact systems that permanently extend into the rocket launcher tube during loading. The present invention eliminates this problem.

In addition it is an object of the present invention to provide a firing system that enhances reproducibility of rocket release conditions.

Finally, it is an object of the present invention to provide a rocket launcher that is relatively simple to load, arm and fire.

Accordingly, the present invention provides a rocket retention and ignition system having at least one retractable detent (retention) and/or ignition mechanism designed to cooperate with a firing ring that encircles the periphery of the rocket being launched.

In operation, the retaining and firing pin(s) (two separate pins in the FIG. 1 embodiment and a single, combined function pin in the FIG. 5 embodiment) is in a retracted (withdrawn) position during an initial stage of rocket loading. Preferably the rocket (such as a 2.75 inch rocket) is loaded into the front of the rocket launcher tubes (although it is envisioned that the rockets can be loaded from the rear as will be hereinafter explained). The rearward motion of the rocket is best halted by a permanent stop or stops in the rear of the launcher tube or by the rear launcher bulkhead. When all of the launcher tubes of a rocket launcher being loaded are filled with rockets, the retaining and firing pin(s) in each tube are linearly extended either mechanically or electronically, into retaining and contact position. In this regard, the hole(s) in the launcher tube wall for the retaining and firing pin(s) is made only so large as to permit entry of the pins into the interior of the launcher tube.

In particular, the retaining pin (or pins, if more than one per tube is desired) extends into an outwardly opening peripheral groove of the rocket so as to retain the rocket. Likewise, the firing pin having a firing contact is extended into contact with a firing contact on the rocket. This contact can be achieved in a multitude of ways well known to those of ordinary skill in the art. For example, there may be a firing ring encircling the periphery of the rocket. The present application shows a firing ring means, but the present invention is not to be so limited, especially if separate retaining and firing pins are utilized. Although, the retaining and firing pins can be extended or retracted separately, it is preferable that they act in tandem. This completes the loading stage. To ensure that the rockets are retained firmly, it is only necessary to manually pull on the front of each rocket.

To fire the rocket, an electrical firing signal is sent through the firing contact of the firing arm to the firing ring of the rocket so as to ignite the rocket fuel. Upon ignition or at a selectable brief interval after ignition of the rocket fuel both the retaining pin and the firing pin are retracted simultaneously (or the firing pin may be retracted first if there is an interval desired) so that the lower surfaces of both pins are flush with the inside wall of the launcher tube, thereby avoiding the direct exhaust of the rocket and eliminating as much as possible the problem of erosion of the holes in the launcher tubes and corrosion of the mechanisms located outside of the launcher tubes. The present invention contemplates both the situation where the retaining and firing pin(s) is normally in the extended position and the situation where the retaining and firing pin(s) is normally in the withdrawn position.

Cleaning is simplified in that only the lower surface of the firing pin needs to be cleaned (if it contains the contact means). Furthermore, this cleaning can be readily done since the firing contact is preferably located relatively near the rear bulkhead and is accessible thereby. Thus, it is unnecessary to dismantle the launcher for the normal cleaning of the firing contact.

Rear loading of the launchers can also be simply accomplished. In this regard, the rear bulkhead must be modified to have the same tube aperture dimension as the front bulkhead, thereby permitting the rockets to be fully insertable therein. A plastic or other soft material ring is placed around the rear periphery of the rocket and aft of the firing ring to act as a stop. This ring must be of such a material that upon firing it will easily slip off the rocket. The retention and ignition system is otherwise the same as described above.

More specifically, the invention provides a rocket retention and ignition system comprising a launch tube having a substantially cylindrical-shaped internal launching cavity for receiving a rocket to be launched, said launch tube having (a) a retaining pin bore passing through the wall of said tube for receiving a linearly reciprocable rocket retaining pin and (b) a firing pin bore passing through the wall of said tube for receiving a linearly reciprocable firing pin; a rocket retaining pin received within said retaining pin bore and being shaped at a retaining end thereof for engaging a retaining groove formed in a rocket received within the launching cavity of said launch tube, the outside diameter of said retaining pin being of substantially the same size as the diameter of said retaining pin bore into which it is received, but sufficiently smaller in diameter than said retaining pin bore to allow for the linear displacement of said retaining pin within said retaining pin bore; first actuable means, rigidly fixed to the outside of said launch tube at said retaining pin bore, for linearly moving said retaining pin between an extended position in which said retaining end of said retaining pin is extended within said launch cavity and a withdrawn position in which said retaining end is withdrawn from said launcher cavity so as to be substantially flush with the inside surface thereof; means for biasing said retaining pin to its extended position, the actuation of said means for moving said retaining pin causing said retaining pin to move to its withdrawn position; a rocket firing pin received within said firing pin bore and having a firing contact at a firing end thereof for engaging a firing contact of a rocket received within the launching cavity of said launch tube, the outside diameter of said firing pin being of substantially the same size as the diameter of said firing pin bore into which it is received, but sufficiently smaller in diameter than said firing pin to allow for the linear displacement of said firing pin within said firing pin bore; second actuable means, rigidly fixed to the outside of said launch tube at said firing pin bore for linearly moving said firing pin between an extended position in which said firing end of said firing pin is extended within said launch cavity and a withdrawn position in which said firing end is withdrawn from said launch cavity so as to be substantially flush with the inside surface thereof; means for biasing said firing pin to its extended position, the actuation of said means for moving said firing pin causing said firing pin to move to its withdrawn position; a firing and control circuit including a load control switch and firing and load control means, coupled to said load control switch for receiving a load command therefrom and adapted to receive a firing command from an external source, said load and firing control means providing (a) upon the application of a load command from said load control switch, an actuation of both first and second actuable means for moving so as to effect the withdrawal of said retaining pin and said firing pin to their respective withdrawn positions, allowing clear passage within said launch cavity for the loading of a rocket, (b) in response to a firing command, generating a firing signal and coupling it to said firing contact, then, after a predetermined interval of time, actuating both of said means for moving to simultaneously withdraw said retaining pin and said firing pin and to continue the application of said signal so as to maintain said pins in said withdrawn position for a second predetermined interval of time.

Another embodiment of the invention involves the combination of the detent and contact means into one retractable mechanism. In this regard, such mechanism is preferably (but not necessarily) designed so as to be in about the same position as the contact means in the earlier described embodiments. The single retractable mechanism holds the rocket by extending into an outwardly opening peripheral groove on the rocket. Furthermore, it acts as a contact means for ignition of the rocket since the firing ring is made a part of the aforesaid outwardly opening peripheral groove on the rocket. More specifically, the invention provides a rocket retention and ignition system comprising at least one rocket launch tube having a bore therethrough; a single rocket retaining and firing pin received within said bore and shaped at a retaining end thereof for engaging a retaining groove formed in a rocket received within the launching cavity of said launch tube, and having a firing contact for electrically engaging a firing contact of said rocket; the outside diameter of said pin being of substantially the same size as the diameter of said bore into which it is received, but sufficiently smaller in diameter than said bore to allow for the linear displacement of said pin within said bore; means for biasing said pin to an extended position thereof, the pin engaging in its extended position the retaining groove of said rocket so as to hold the rocket within the launching cavity and the firing contact of said pin electrically contacting the firing contact of said rocket; means for conducting a rocket firing signal to said firing contact of said pin; actuable means for linearly moving said pin between its extended position and a withdrawn position whereat the end of said pin is substantially flush with the inside wall of said launching cavity.

In addition to the rocket retention and ignition apparatus described, the invention also provides a method for firing a rocket from a rocket launcher, comprising the steps of providing a launch tube having a substantially cylindrically shaped internal launching cavity for receiving a rocket to be launched; the launch tube having at least one bore passing through a wall thereof for receiving a linearly reciprocal rocket retaining and firing pin(s); providing a rocket retaining and firing pin(s) received within said bore(s) and shaped at a retaining end thereof for engaging a retaining groove formed in a rocket received within the launching cavity of the launch tube; the outside of the diameter of the pin(s) being of substantially of the same size as the diameter of the bore(s) into which it is received, but sufficiently smaller in diameter than the bore(s) to allow for the linear displacement of the pin(s) within the bore(s); providing electrically actuable means, rigidly fixed to the outside of the launch tube at the bore(s) for linearly moving the pin(s) between an extended position in which its retaining end is extended within the launch cavity and a withdrawn position in which the retaining end is withdrawn from the launcher cavity so as to be substantially flush with the inside surface thereof; biasing the pin(s) to its extended position, the actuation of the actuable means moving the pin to its withdrawn position; providing a load control switch; receiving a firing command from an external source; generating, in response to the firing command, a firing signal and coupling it to the firing contact, then, after a predetermined interval of time, actuating the means for moving so as to withdraw the pin to its withdrawn position and to continue the application of a signal thereto so as to maintain the pin in its withdrawn position for a second predetermined interval of time, after which the pin returns to its respective extended position under the action of its means for biasing; and generating in response to the actuation of the load control switch an electrical signal for actuating both of the actuable means for moving so as to effect the withdrawal of the pin to its withdrawn position allowing clear passage within the launch cavity for the loading of the rocket.

The rocket retention and ignition system of the present invention can be used in single or multiple tube rocket launchers, and to both ground-based and airborne launchers. Where more than one launch tube is used, the rockets may be fired individually, in groups, all at once or in "ripple" sequence by means well known to those of ordinary skill in the art. It is particularly useful in circumstances wherein the launcher will be frequently used and/or wherein servicing of the launcher is difficult or impossible.

BRIEF DESCRIPTION OF THE DRAWINGS

The invention will be better understood by reference to the following detailed best mode description when read in conjunction with the appended claims and the drawings wherein like reference numerals refer to like or corresponding parts or elements throughout and wherein:

DETAILED DESCRIPTION OF THE PREFERRED EMBODIMENTS

Figure 1:
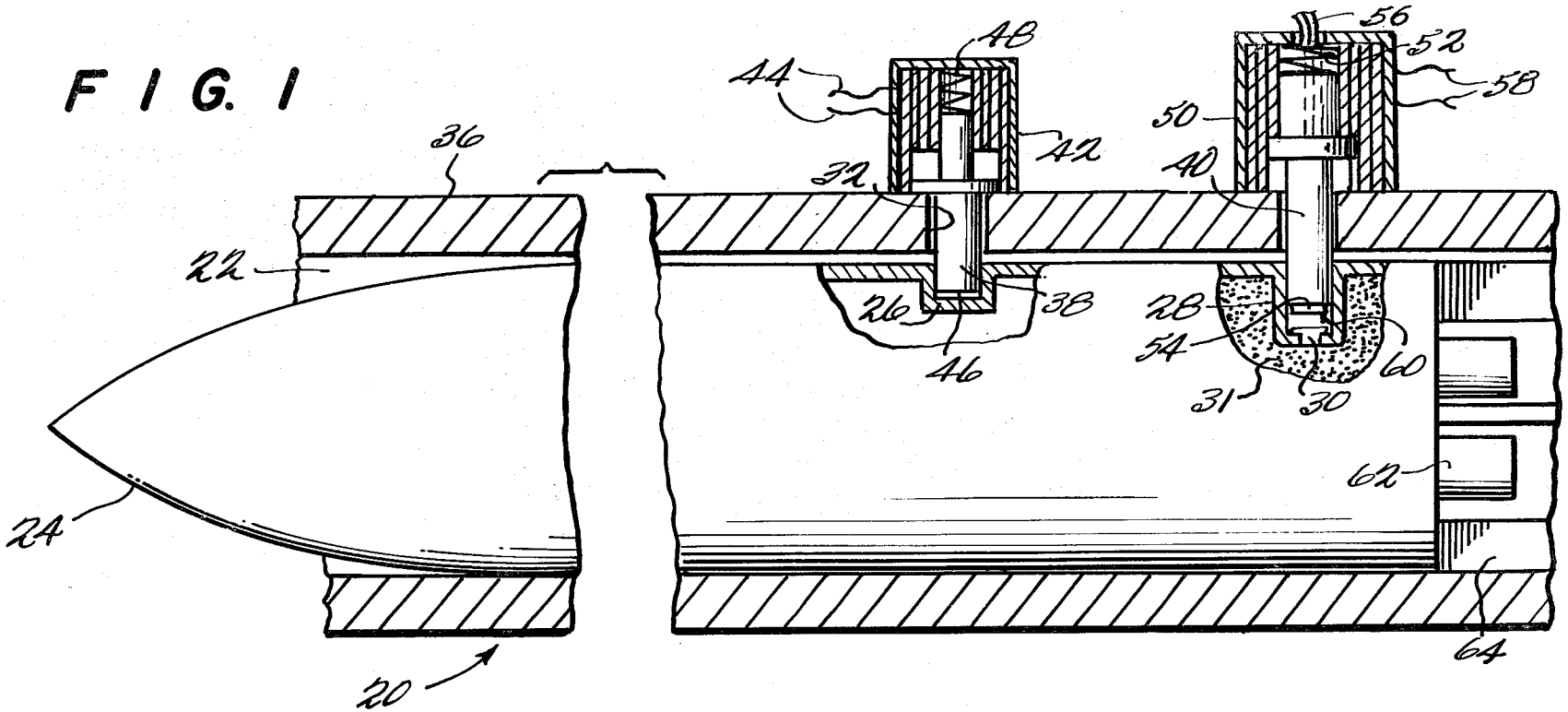
FIG. 1 is a cutaway view of a first embodiment of the rocket retention and ignition system according to the present invention.
Figure 5:
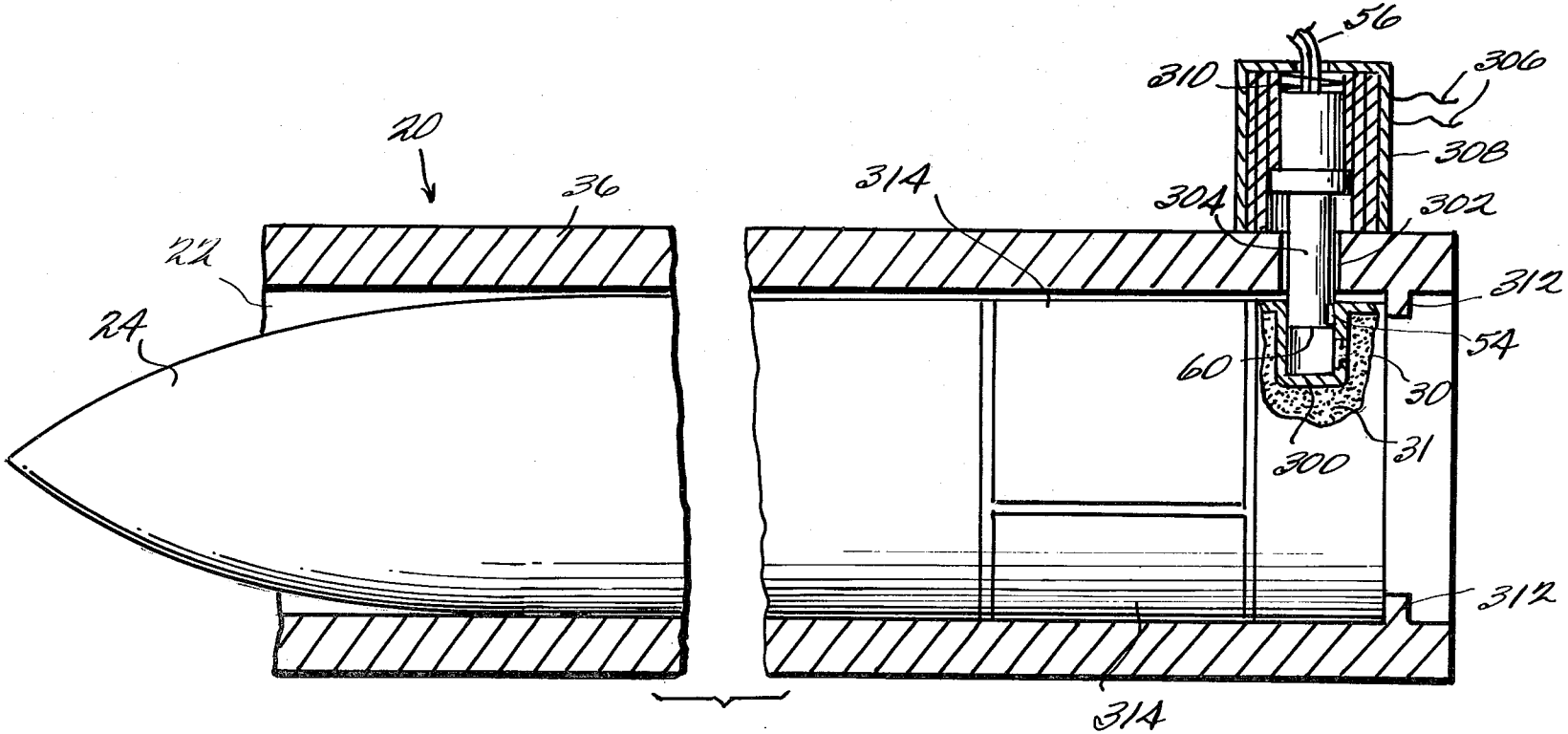
FIG. 5 is a partial cutaway view of a second embodiment of the rocket retention and ignition system using only a single pin to provide the functions of both a retaining pin and a firing pin shown separately in the FIG. 1 embodiment.

Referring now to FIG. 1, there is shown a partially cutaway side view of a first embodiment of the rocket retention and ignition system according to the present invention. This first embodiment includes separate retaining and firing pins. Although it may be preferred to utilize a single dual function pin embodiment as shown in FIG. 5, it is believed that description of the FIG. 1 embodiment first will render the invention more easily understood.

A rocket launcher incorporating this sytem may include one or more launch tubes 20, only one of which is illustrated, having a generally cylindrically shaped internal launching cavity 22 for receiving a rocket 24 to be launched.

Rocket 24 has a retaining groove 26 formed therein providing a means for securing the rocket within launching cavity 22 after it has been loaded therein and before it is fired. Rocket 24 also includes a firing groove 28 with a rocket firing contact 30 for conducting an externally provided firing signal to an ignition pyrotechnic 31 within the rocket.

Launch tube 20 includes a retaining pin bore 32 and a firing pin bore 34 through the relatively thin wall 36 of launch tube 20. Bores 32 and 34 are preferably radial with respect to the axis of rotation of the cylindrical launch cavity. However, other bore arrangements can be made to accommodate rocket retaining groove and firing groove configurations without departing from the spirit of the invention. A retaining pin 38, having a diameter only slightly smaller than the diameter of retaining pin bore 32 is positioned within the retaining pin bore and held so as to be linearly movable therein. The diameter of retaining pin 38 is selected so as to fit as tightly as possible within retaining pin bore 32 while still being readily movable therein. Similarly, a firing pin 40, having a diameter only slightly less than the diameter of firing pin bore 34 is positioned within the firing pin bore and held so as to be movable therein. The diameter of firing pin 40 is selected so as to fit as tightly as possible within the firing pin bore while still being readily movable therein.

Retaining pin 38 is rigidly attached to the plunger of a retaining pin solenoid 42 having an actuating signal line 44. Solenoid 42 includes a biasing spring 48 for normally biasing retaining pin 38 so that it is extended within the launching cavity so as to engage retaining groove 26 of a rocket 24 loaded therein. When an actuating signal is applied to signal line 44 to energize solenoid 42, the solenoid drive plunger pulls retaining pin 38 against the bias of spring 48 to withdraw it from the launch cavity. Retaining pin 38 is sized and positioned such that in its withdrawn position, the end 46 of the retaining pin is flush with the inside wall of the launch tube and substantially covers retaining pin bore 32. This particular construction provides protection from deterioration of retaining pin 38 and its drive mechanism from rocket exhausts within launching cavity 22 resulting from a rocket launch.

Firing pin 40 is rigidly attached to the plunger of a firing pin solenoid 50. Solenoid 50 includes a spring 52 for biasing firing pin 40 such that it is extended into launching cavity 22 to make contact with a rocket 24 loaded therein. Firing pin 40 includes a firing pin contact 54 that covers the end of the firing pin. Contact 54 is electrically coupled to a firing signal line 56 for receiving a firing signal. A solenoid actuation line 58 coupled to a solenoid winding provides a means for selectively actuating solenoid 50. When solenoid 50 is actuated by a signal on line 58, the plunger of the solenoid pulls firing pin 40 against the bias of spring 52 to a withdrawn position. For illustrative purposes only, firing pin 40 is shown in a position midway between its extended and withdrawn portions so that contacts 30 and 54 can be easily seen. Firing pin 40 is sized and positioned such that in its withdrawn position, the bottom surface 60 of firing pin 40 is flush with the inside surface of wall 36 forming launching cavity 22. Thus, bottom surface 60 of firing pin 40 effectively blocks firing pin bore 34 and shields the firing pin and solenoid from rocket exhaust. For the sake of completeness also shown in the Figure are two rocket exhaust pipes 62 and rocket fins 64 of rocket 24.

In examining FIG. 1 (and also FIG. 5) it should be borne in mind that the relative dimensions shown therein are only for the purpose of highlighting the various components of the present invention and, thus, do not reflect the actual dimensions of the best mode. In this regard, the solenoid (or equivalent electrical, mechanical, pneumatic or other structure) in the best mode should be made as small as practical, particularly where multiple launch tubes are involved having relatively little space between such launch tubes.

Figure 2:
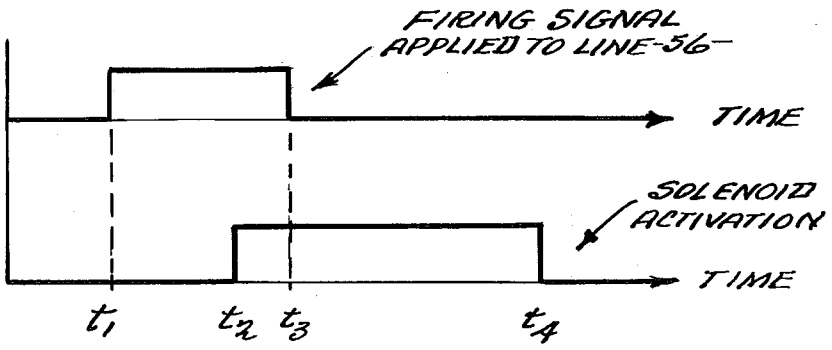
FIG. 2 is a timing diagram illustrating the operation of the rocket retention and ignition system.

Referring now to FIG. 2 there is shown a timing diagram illustrating the temporal relationship of a firing signal applied to line 56 and solenoid actuation signals applied to solenoid actuation lines 44 and 58. Sometime after a rocket 24 is loaded within launching cavity 22, the rocket will be launched. It is preferably advantageous to apply a firing signal to the rocket for igniting it and then, after a predetermined relatively brief interval of time, to simultaneously withdraw retaining pin 38 and firing pin 40 from their respective extended positions to their respective withdrawn positions, allowing free passage of rocket 24 from the launching cavity 22. As shown graphically, a firing signal is applied to the line 56 beginning at a time $t_1$ and continuing until a time $t_3$. After a predetermined interval of time has elapsed from the onset of the firing signal at time $t_1$, a solenoid actuation signal is applied at a time $t_2$ to solenoid actuation lines 44 and 58. This solenoid actuation signal continues to be applied for a predetermined interval of time until a time $t_4$, allowing rocket 24 sufficient time to be launched from cavity 22 and for the exhaust gases therefrom to be substantially dissipated. The time interval $t_2 - t_1$ is a function of the specific rocket design and relates to pyrotechnic 31 (shown in FIG. 1) ignites the rocket.

Figure 3:
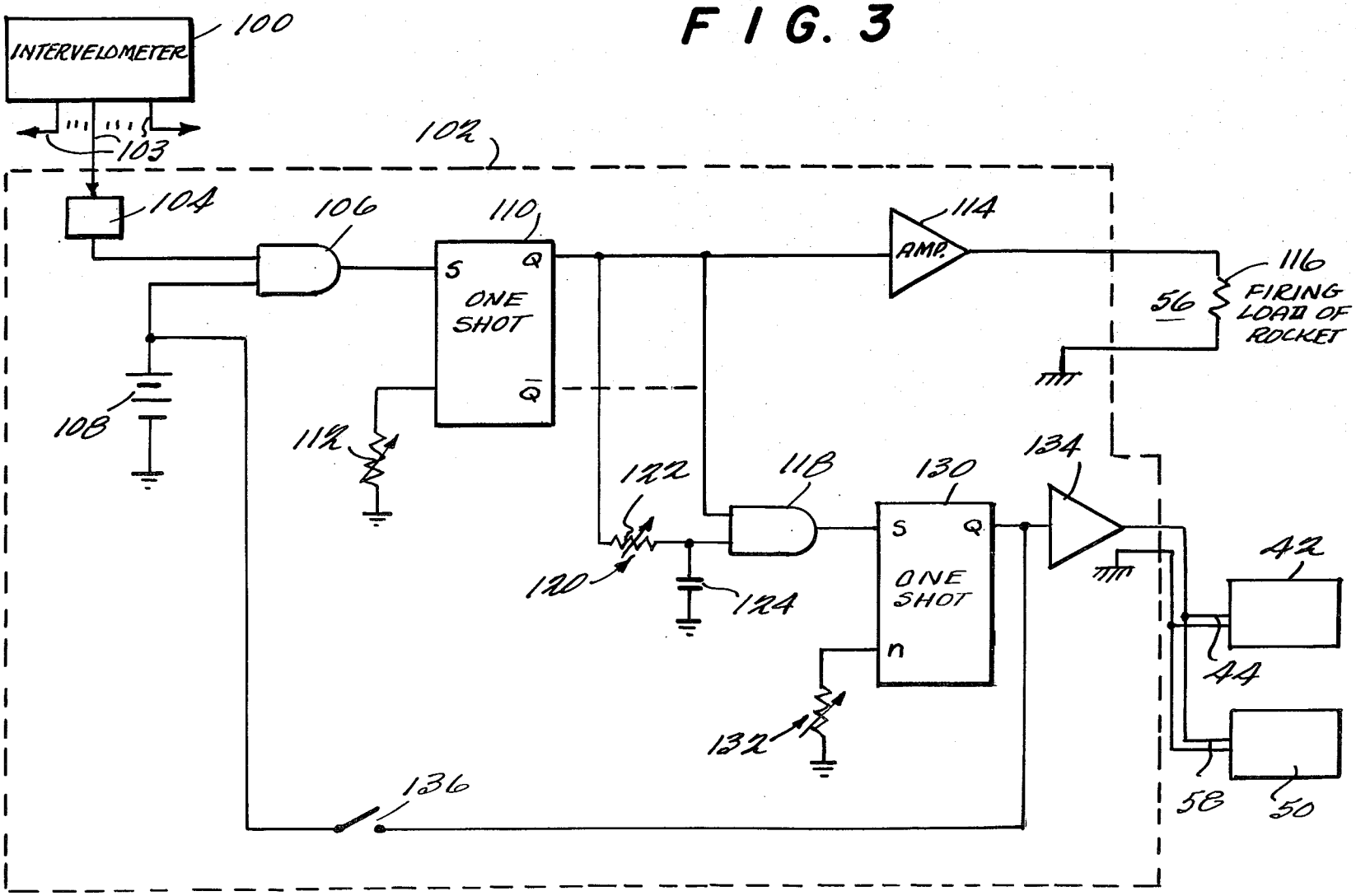
FIG. 3 is an electronic schematic diagram for a first embodiment of an electronic control system forming part of the rocket retention and ignition system.
Figure 6:
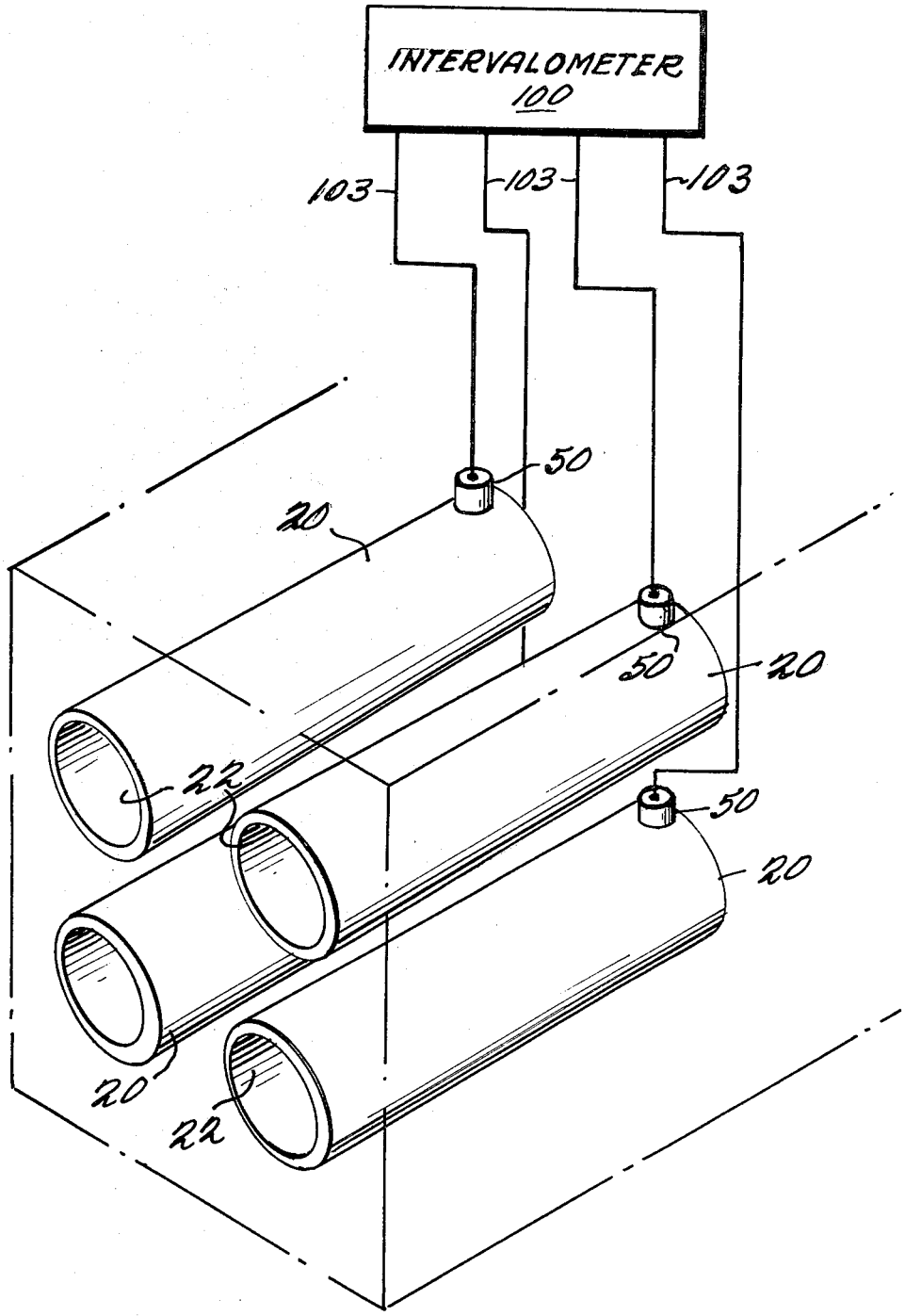
FIG. 6 is a schematic view of a firing system having multiple launch tubes, each tube having a rocket retaining and firing pin.

Referring now to FIG. 3 there is shown a schematic diagram of a first embodiment of a control circuit 102 which provides the signals shown in FIG. 2. Typically, the firing of a rocket launcher is initiated by a launch control operator using an intervalometer 100. Intervalometer 100 provides firing signals at a plurality of output lines 103 according to a predetermined sequence and at predetermined intervals to a rocket launcher having a plurality of launch tubes such as launch tube 20 shown in FIG. 1. For simplicity, only a single launch tube 20 (see FIG. 1) and a single control circuit 102 (shown in FIG. 3) is set forth. However, in the event a multiple launch tube launcher (such as shown in FIG. 6) is used, there is one such control circuit 102, as shown in FIG. 3, for each launch tube 20. Output lines 103 of intervalometer 100 are coupled one each to each such control circuit 102. Control circuit 102 is preferably secured to the rocket launcher. It would include a terminal 104 for receiving an output line 103 from intervalometer 100 and would provided signals on firing signal line 56 and solenoid actuation lines 44 and 58.

A pulse signal from intervalometer 100, coupled via a line 103 to terminal 104 is coupled to a first input of an AND gate 106. A second input of AND gate 106 is coupled to a voltage source 108. When a pulse signal from intervalometer 100 occurs, the output of AND gate goes high to provide a set pulse to a one-shot 110. One-shot 110 provides an output pulse on its Q output for a predetermined interval of time controllable by a timing control 112 represented in the Figure by a variable resistor. Typically, the pulse duration provided by one-shot 110 is less than one second. The Q output of one-shot 110 is coupled to an amplifier 114 for generating a firing signal coupled onto firing signal line 56 for igniting a rocket 24 to be launched. The firing load of the igniter within rocket 24 is represented in this Figure by a resistor 116.

The Q output pulse from one-shot 110 is also coupled directly to a first input of an AND gate 118 and to a second input of AND gate 118 through a delay circuit 120. Delay circuit 120 is represented by a RC circuit including a variable resistor 122 and a capacitor 124. As shown, delay circuit 120 is formed by an integrator. Of course, any other type of delay circuit may be substituted without departing from the scope of the present invention.

AND gate 118, receiving both a signal directly from the Q output of one-shot 110 and a delayed Q signal, generates an output pulse coincident with the delayed signal coupled to its second input. Of course, the pulse duration of the Q output of one-shot 110 and the delay time must be set so that there is, at least for some point in time, a coincidence of signal inputs to AND gate 118. The output of AND gate 118 is coupled to the set input of a one-shot 130, the output duration of which is controlled by a timer element 132 represented in the Figure by a variable resistor. The Q output of one-shot 130 is coupled to a solenoid driver 134 which supplies a solenoid actuation signal to lines 44 and 58 for triggering solenoids 42 and 50, respectively. The delay provided by delay circuit 120 in effect provides the interval of time $t_2-t_1$ so that the solenoids are actuated at time $t_2$ later than time $t_1$ when the firing signal is applied.

In order to load a rocket 24 into launching cavity 22, it is necessary to actuate solenoids 42 and 50 without applying a firing signal to line 56. Therefore, a load control switch 136 is coupled between voltage source 108 and the input of solenoid driver 134. By closing load control switch 136, a user can actuate both solenoids for as long a time as necessary to load a rocket 24 within launch cavity 22. In circuit, as shown the retaining pin 38 and firing pin 40 will only be withdrawn so long as load control 136 is held closed. Of course, in a more sophisticated embodiment, additional one-shot circuits could be provided such that a short closure of load control switch 36 would hold a solenoid actuating signal on lines 44 and 58 for a predetermined interval of time, after which the signal would be removed and the pins would return to their extended positions under the action of their respective bias springs.

Figure 4:
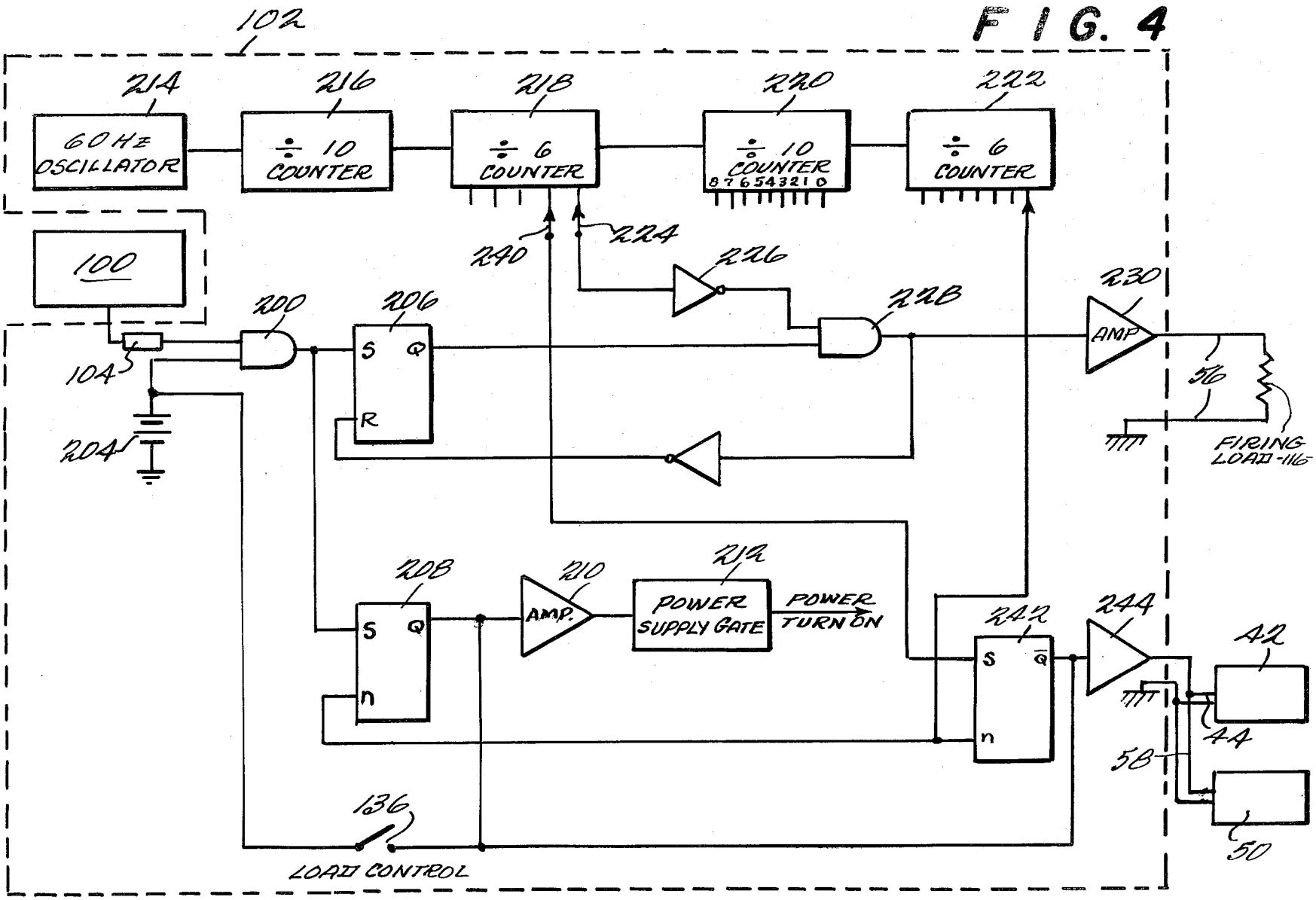
FIG. 4 is an electronic schematic diagram of a second embodiment of the electronic and control system of the rocket retention and ignition system.

Referring now to FIG. 4 there is shown an alternate embodiment for control circuit 102. The intervalometer pulse signal, coupled to control circuit 102 through terminal 104 is coupled to a first input of an AND gate 200. A second input of AND gate 200 is coupled to a voltage source 204. When an intervalometer pulse occurs, AND gate 200 produces a pulse at an output thereof. The output pulse of AND gate 200 is coupled to the set input of a flip-flop 206. Flip-flop 206, in response to a set signal, provides a logic level high on its Q output. The output from AND gate 200 is also coupled to the set input of a flip-flop 208 having a Q output coupled to an amplifier 210. The output of amplifier 210 is coupled to a power supply gate 212 for controlling the application of power to various components of firing and control circuit 102.

Although power is continuously applied to AND gate 200, flip-flops 206 and 208, amplifier 210, and the power supply gate 212, power to the remaining components to be described, is applied only via the power supply gate. Until a signal from amplifier 210 "turns on" the power supply gate, the remaining components are not powered. When an intervalometer pulse is coupled to terminal 104 and AND gate 200 sets flip-flop 206, a logic level high signal appears on the Q output thereof. Simultaneously, the power supply gate 212 is turned on via flip-flop 208 and amplifier 210. This applies power to a 60 Hz oscillator 214 and a string of counter-type dividers 216, 218, 220 and 222. The 60 hz pulses provided by oscillator 214 are coupled to divide by ten counter 216 having an output coupled to a divide by six counter 218. Counter 218 provides at its output, a stream of pulses occurring one each second. Counter 218 includes a plurality of output taps providing pulses occurring more frequently than one each second in addition. One such tap 224 provides a signal to an inverter 226 which is in turn coupled to a first input of an AND gate 228. A second input of AND gate 228 is coupled to the Q output of flip-flop 206. Thus, AND gate 228 provides at its output, a signal that is delayed in time from the initial firing pulse provided by intervalometer 100. The time delay is a function of the frequency of oscillation of oscillator 214 and the divide values of counters 216 and 218. The output of AND gate 228 is coupled to an amplifier 230 providing a firing signal coupled to firing line 56. As in FIG. 3, the firing load of the igniter of a rocket 24 is represented by a resistor 116.

Continuing to refer to FIG. 4, firing and control circuit 102 also provides solenoid actuation signals on lines 44 and 58 that are delayed by the time interval $t_2-t_1$ as shown in FIG. 2. An output tap 240 of divider 218 is coupled to the set input of a flip-flop 242. The Q output of flip-flop 242 is coupled to the input of a solenoid driver 244 for providing a solenoid actuating signal to solenoids 42 and 50 via lines 44 and 58, respectively. Tap 240 of divider 218, in essence, provides the time interval $t_2-t_1$ shown in FIG. 2. The reset input of flip-flop 242 is coupled to a tap 250 of divider 222. This provides for flip-flop 242 being reset after an interval of time $t_2-t_4$ as shown in FIG. 2.

The Q output of flip-flop 242, in addition to being coupled to the input of solenoid driver 244 is fed back to the input of amplifier 210 for maintaining power supply gate 212 after the intervalometer pulse has vanished.

In order to provide a means for loading a rocket 24 into launch tube 20, a load control switch 136 is provided coupling voltage source 204 directly to the input of solenoid driver 244. Thus, whenever load control switch 136 is depressed, a solenoid signal will be provided to solenoids 42 and 50. Oneshot circuitry could be provided in a more sophisticated embodiment for maintaining the solenoids actuated for a predetermined interval of time during which rockets can be loaded.

Referring now to FIG. 5 there is shown a partial cutaway view of a second embodiment of the rocket retention and ignition system according to the present invention. This particular embodiment is intended for use in launching a rocket 24 having a single retaining and firing groove 300 located behind fins 314. In this embodiment, rocket 24 is inserted into launch cavity 22 of launch tube 20 having a wall 36. Stop 312 is used to assist in loading rocket 24. A single bore 302 is provided through wall 36. A single retaining and firing pin 304 is positioned within bore 302. Pin 304 is sized so that it fits as snugly as possible within bore 302 while still allowing free movement therein.

Pin 304 includes a firing contact 54 located on the side of pin 304 near its end 60. Firing contact 54 is designed to mate with a firing contact 30 provided in rocket 24 and electrically coupled to pyrotechnic 31 for igniting the rocket. Pin 304 may include a key, with a corresponding groove formed in bore 302 to prevent rotation of pin 304 about its center line so that contact 54 will always mate with contact 30 when pin 304 is extended after a rocket has been loaded into the tube. In all other respects, this embodiment operates in the same manner as the system shown in the FIG. 1 embodiment. A control circuit 102 as shown in either FIG. 3 or 4 produces a firing signal coupled to a firing signal line 56. This firing signal is coupled through pin 304 to firing contact 54. At some time $t_2$ later than $t_1$, control circuit 102 produces a solenoid actuating signal coupled to a solenoid actuating line 306 to actuate a solenoid 308 for withdrawing 304 against the bias of a spring 310. In its withdrawn position, the end 60 of pin 304 is flush with the inside wall 36 of launch tube 20 so that rocket exhaust gases will not enter bore 302 and destroy the ignition and firing system.

While the invention has been described in connection with what is presently considered to be the most particular and preferred embodiments, it is to be understood that the invention is not to be limited to the disclosed embodiments but on the contrary is intended to cover various modifications and equivalent arrangements included within the spirit and scope of the appended claims which scope is to be accorded the broadest interpretation so as to encompass all such modifications and equivalent structures. For example, the solenoid shown in the drawings can be readily replaced by equivalent electrical, mechanical or pneumatic means.

We claim:

1. A rocket retention and ignition system comprising:

at least one rocket launch tube having a launching cavity therein for receiving a rocket to be launched and having a bore through a wall thereof for accommodating a retaining and firing pin;

a single rocket retaining and firing pin positioned so as to be linearly movable through said bore between a withdrawn position and an extended position wherein the pin extends into said launching cavity and shaped at a retaining end thereof for engaging, when extended, a retaining groove formed in a rocket received within said launching cavity, and having a firing contact for electrically engaging a firing contact of said rocket, the outside diameter of said retaining pin being of substantially the same size as the diameter of said bore in which it is received, but sufficiently smaller in diameter than said bore to allow for the linear displacement of said pin within said bore;

means for moving said pin to either its extended position for engaging the retainer groove of the rocket or to its withdrawn position for disengaging a rocket being launched or for permitting the loading or a rocket into the launch tube; and means for conducting a rocket firing signal to said firing contact of said pin to fire said rocket.

2. A system according to claim 1, further comprising means for biasing said pin to an extended position thereof, the pin engaging in its extended position the retaining groove of said rocket so as to hold the rocket within the launching cavity and the firing contact of said pin electrically contacting the firing contact of said rocket; and wherein said means for moving comprises actuable means for linearly moving said pin between its extended position and its withdran position whereat the end of said pin is substantially flush with an inside wall of said launching cavity.

3. A rocket retention and ignition system according to claim 2 wherein said actuable means comprises an electrically actuable solenoid having a plunger rigidly coupled to said pin.

4. A system according to claim 3 further comprising control circuit means for providing (a) a firing signal coupled to the firing contact of said pin and (b) providing at a predetermined time interval after said firing signal a solenoid actuation signal for actuating said actuable means for withdrawing said pin from its extended position to its withdrawn position.

5. A system according to claim 4 wherein said control circuit means comprises:

a first one shot circuit for generating said firing signal responsive to an externally generated firing command coupled thereto;

a delay circuit, coupled to said first one shot for generating a delay signal having a predetermined delay with respect to said firing signal;

a signal one shot circuit for generating said actuation signal responsive to said delay signal;

a load control switch; and means for generating said actuation signal in response to the closure of said load control switch.

6. A system according to claim 4 wherein said control circuit means comprises:

a normally unpowered oscillator for generating a clock signal upon the application of power thereto;

normally unpowered counter means for counting the cycles of said clock signal upon the application of power thereto;

a power gate for controllably applying power to said oscillator and counter means;

first circuit means, adopted to reduce an externally generated firing command and (a) actuate, in response thereto, said power gate to apply power to said oscillator and counter means and (b) generate said firing signal after a first predetermined count by said counter means; and second circuit means for generating after a second predetermined count of said counter means, said actuation signal;

a load control switch; and means for generating said actuation signal in response to said load control switch.

7. A system according to claim 4 wherein said control circuit means comprises:

means for generating the firing signal beginning at a first predetermined time and terminating at a third time after a predetermined interval measured from said first time; and means for generating the solenoid actuation signal beginning at a second time having a predetermined relationship to said first time and terminating at a fourth time after a predetermined interval measured from said second time.

8. A system according to claim 7 wherein said second time occurs between said first and third times.

9. A rocket retention and ignition system, comprising:

at least one rocket launch tube having a bore therethrough forming a launching cavity for receiving a rocket to be launched;

said launch tube having (a) a retaining pin bore passing through the wall of said tube for receiving a linearly reciprocable rocket retaining pin and (b) a firing pin bore passing through the wall of said tube for receiving a linearly reciprocable firing pin;

a rocket retaining pin positioned so as to be linearly movable between a withdrawn position and an extended position within said retaining pin bore and being shaped at a retaining end thereof for engaging, when extended, a retaining groove formed in a rocket received within the launching cavity of said launch tube, the outside diameter of said retaining pin being of substantially the same size as the diameter of said retaining pin bore into which it is received, but sufficiently smaller in diameter than said retaining pin bore to allow for the linear displacement of said retaining pin within said retaining pin bore;

a rocket firing pin positioned so as to be linearly movable between a withdrawn position and an extended position within said firing pin bore and having a firing contact at a firing end thereof for engaging, when extended, a firing contact of a rocket received within the launching cavity of said launch tube, the outside diameter of said firing pin being of substantially the same size as the diameter of said firing pin bore into which it is received, but sufficiently smaller in diameter than said firing pin bore to allow for the linear displacement of said firing pin within said firing pin bore;

means for moving said firing and retaining pins to either their respective extended positions for engaging respectively the rocket firing contact and retaining groove or to their respective withdrawn positions for respectively disengaging from a rocket being launched or for permitting the loading of a rocket into the launch tube; and means for conducting a rocket firing signal to said firing pin firing contact so as to fire said rocket.

10. A system according to claim 9 wherein said means for moving comprises first actuable means, rigidly fixed to the outside of said launch tube and said retaining pin bore, for linearly moving said retaining pin between an extended position in which said retaining end of said retaining pin is extended within said launch cavity and a withdrawn position in which said retaining end is withdrawn from said launcher cavity to as to be substantially flush with the inside surface thereof, and second actuable means, rigidly fixed to the outside of said launch tube at said firing pin bore for linearly moving said firing pin between an extended position in which said firing end of said firing pin is extended within said launch cavity and a withdrawn position in which said firing end is withdrawn from said launch cavity so as to be substantially flush with the inside surface thereof;

wherein said system further comprises means for biasing said retaining pin to its extended position, the actuation of said actuable means for moving said retaining pin causing said retaining pin to move to its withdrawn position, and means for biasing said firing pin to it extended position, the actuation of said means for moving said firing pin causing said firing pin to move to its withdrawn position; and wherein said means for conducting a firing signal comprises a firing and control circuit including a load control switch and firing and load control means, coupled to said load control switch for receiving a load command therefrom and adapted to receive a firing command from an external source, said load and firing control means providing (a) upon the application of a load command from said load control switch, an actuation of both first and second actuable means for moving so as to effect the withdrawal of said retaining pin and said firing pin to their respective withdrawn positions, allowing clear passage within said launch cavity for the loading of a rocket, (b) in response to a firing command, generating a firing signal and coupling it to said firing contact, then, after a predetermined interval of time, actuating both of said means for moving to simultaneously withdraw said retaining pin and said firing pin and to continue the application of said signal so as to maintain said pin in said withdrawn position for a second predetermined interval of time, after which said pins return to their respective extended positions under the action of their respective means for biasing.

11. A rocket retention and ignition system according to claim 10 wherein said first and second actuable means comprises electrically actuable solenoids.

12. A system according to claim 10 wherein said firing and control circuit comprises:

a normally unpowered oscillator for generating a clock signal upon the application of power thereto;

normally unpowered counter means for counting the cycles of said clock signal upon the application of power thereto;

a power gate for controllably applying power to said oscillator and counter means;

first circuit means, adopted to reduce an externally generated firing command and (a) actuate, in response thereto, said power gate to apply power to said oscillator and counter means and (b) generate said firing signal after a first predetermined count by said counter means; and second circuit means for generating after a second predetermined count of said counter means, said actuation signal;

a load control switch; and means for generating said actuation signal in response to said load control switch.

13. A system according to claim 10 wherein said control circuit comprises:

a normally unpowered oscillator for generating a clock signal upon the application of power thereto;

normally unpowered counter means for counting the cycles of said clock signal upon the application of power thereto;

a power gate for controllably applying power to said oscillator and counter means;

first circuit means, adopted to reduce an externally generated firing command and (a) actuate, in response thereto, said power gate to apply power to said oscillator and counter means and (b) generate said firing signal after a first predetermined count by said counter means; and second circuit means for generating after a second predetermined count of said counter means, said actuation signal;

a load control switch; and means for generating said actuation signal in response to said load control switch.

14. A system according to claim 10 wherein said control circuit comprises:

means for generating the firing signal beginning at a first predetermined time and terminating at a third time after a predetermined interval measured from said first time; and means for generating the solenoid actuation signal beginning at a second time having a predetermined relationship to sid first time and terminating at a fourth time after a predetermined interval measured from said second time.

15. A system according to claim 14 wherein said second time occurs between said first and third times.

16. A method for firing a rocket from a rocket launcher, comprising the steps of:

providing at least one rocket launch tube having a bore therethrough forming a launching cavity for receiving a rocket to be launched, said launch tube having (a) a retaining pin bore passing through the wall of said tube for receiving a linearly reciprocable rocket retaining pin and (b) a firing pin bore passing through the wall of said tube for receiving a linearly reciprocable firing pin;

providing a rocket retaining pin received within said retaining pin bore and being shaped at a retaining end thereof for engaging a retaining groove formed in a rocket received within the launching cavity of said launch tube, the outside diameter of said retaining pin being of substantially the same size as the diamter of said retaining pin bore into which it is received, but sufficiently smaller in diameter than said retaining pin bore to allow for the linear displacement of said retaining pin within said retaining pin bore;

providing first actuable means, rigidly fixed to the outside of said launch tabs at said retaining pin bore, for linearly moving said retaining pin between an extended position in which said retaining end of said retaining pin is extended within said launch cavity and a withdrawn position in which said retaining end is withdrawn from said launcher cavity so as to be substantially flush with the inside surface thereof;

biasing said retaining pin to its extended position, the actuation of said first actuable means causing said retaning pin to move to its withdrawn position, providing a rocket firing pin received within said firing pin bore and having a firing contact at a firing end thereof for engaging a firing contact of a rocket received within the launching cavity of said launch tube, the outside diameter of said firing pin being of substantially the same size as the diameter of said firing pin bore into which it is received, but sufficiently smaller in diameter than said firing pin bore to allow for the linear displacement fo said firing pin within said firing pin bore;

providing second actuable means, rigidly fixed to the outside of said launch tube at said firing pin bore for linearly moving said firing pin between an extended position in which said firing end of said firing pin is extended within said launch cavity and a withdrawn position in which said firing end is withdrawn from said launch cavity so as to be substantially flush with the inside surface thereof;

biasing said firing pin to its extended position, the actuation of said second actuable means causing said firing pin to move to its withdrawn position;

providing and actuating a load control switch;

generating, in response to an actuation of said load control switch, an electrical signal for actuating both of said electrically actuable means for moving so as to effect the withdrawal of said retaining pin and said firing pin to their respective withdrawn position, allowing clear passage within said launch cavity for the loading of a rocket;

loading a rocket into said launching cavity;

actuating the load control switch so as to remove the electrical signal from said electrically actuable means, permitting the retaining and firing pins to move in response to their respective biases to their respective extended positions to engage said rocket; and receiving a firing command from an external source; and upon receiving a firing command, generating a firing signal and coupling it to said firing contact, then, after a predetermined interval of time, actuating both of said first and second actuable means to simultaneously withdraw said retaining pin and said firing pin and to continue the application of said signal so as to maintain said pin in said withdrawn position for a second predetermined interval of time, after which said pins return to their respective extended positions under the action of their respective means for biasing.

17. A rocket retention and ignition system, comprising:

a launch tube having a substantially cylindrical-shaped internal launching cavity for receiving a rocket to be launched, said launch tube having a firing and retaining pin bore passing through the wall of said time for receiving a linearly reciprocate rocket retaining pin and a rocket firing and retaining pin received within said retaining pin bore and being shaped at a retaining and firing end thereof for engaging a retaining groove formed in a rocket received within the launching cavity of said launch tube and having a firing contact for engaging a firing contact on said rocket, the outside diameter of said firing and retaining pin being of substantially the same size as the diameter of said firing and retaining pin bore into which it is received, but sufficiently smaller in diameter than said firing and retaining pin bore to allow for the linear displacement of said retaining pin within said retaining pin bore; and actuable means, rigidly fixed to the outside of said launch tube at said firing and retaining pin bore, for linearly moving said firing and retaining pin between an extende position in which said retaining end of said firing and retaining pin is extended within said launch cavity for engaging the firing contact and retaining groove of the rocket and a withdrawn position in which said retaining end is withdrawn from said launcher cavity so as to be substantially flush with the inside surface thereof; and means for conducting a rocket firing signal to said firing contact of said pin to fire said rocket.

18. A rocket retention and ignition system according to claim 17 wherein said electrically actuable means comprises a solenoid.

19. A system according to claim 17 wherein said means for conducting comprises:

means for generating the firing signal beginning at a first predetermined time and terminating at a third time after a predetermined interval measured from said first time; and means for generating the solenoid actuation signal beginning at a second time having a predetermined relationship to said first time and terminating at a fourth time after a predetermined interval measured from said second time.

20. A system according to claim 19 wherein said second time occurs between said first and third times.

21. A system according to claim 17 further comprising means for biasing said firing and retaining pin to its extended position, the actuation of said means for moving said firing and retaining pin causing said retaining pin to move to its withdrawn position, and wherein said means for conducting comprises a firing and control circuit including a load control switch and firing and load control means, coupled to said load control switch for receiving a load command therefrom and adapted to receive a firing command from an external source, said load and firing control means providing (a) upon the application of a load command from said load control switch, an electrical signal for actuating said electrically actuable means for moving so as to effect the withdrawal of said firing and retaining pin to its withdrawn position, allowing clear passage within said launch cavity for the loading of a rocket, (b) in response to a firing command, generating a firing signal and coupling it to said firing contact of said firing and retaining pin, then, after a predetermined interval of time, actuating said means for moving to withdraw said firing and retaining pin and to continue the application of said signal so as to maintain said pin in said withdrawn position for a second predetermined interval of time, after which said gas returns to its extended position under the action of said means for biasing.

22. A system according to claim 21 wherein said control circuit comprises:

a first one shot circuit for generating said firing signal responsive to an externally generated firing command coupled thereto;

a delay circuit, coupled to said first one shot for generating a delay signal having a predetermined delay with respect to said firing signal;

a second one shot circuit for generating said actuation signal responsive to said delay signal;

a load control switch; and means for generating said actuation signal in response to the closure of said load control switch.

23. A system according to claim 21 wherein said control circuit comprises:

a normally unpowered oscillator for generating a clock signal upon the application of power thereto;

normally unpowered counter means for counting the cycles of said clock signal upon the application of power thereto;

a power gate for controllably applying power to said oscillator and counter means;

first circuit means, adopted to reduce an externally generated firing command and (a) actuate, in response thereto, said power gate to apply power to said oscillator and counter means and (b) generate said firing signal after a first predetermined count by said counter means; and second circuit means for generating after a second predetermined count of said counter means, said actuation signal;

a load control switch; and means for generating said actuation signal in response to said load control switch.

24. A method for firing a rocket from a rocket launcher comprising the steps of:

providing a launch tube having a substantially cylindrically shaped interval luanching cavity for receiving a rocket to be launched, the launch tube having a bore passing through a wall thereof for receiving a linearly reciprocal rocket retaining and firing pins;

providing a rocket retaining and firing pin received within said bore and shaped at a retaining end thereof for engaging a retaining groove formed in a rocket received within the launching cavity of the launch tube, the outside of the diameter of the pin being of substantially of the same size as the diameter of the bore into which it is received, but sufficiently smaller in diameter than the bore to allow for the linear displacement of the pin within the bore;

providing electrically actuable means, rigidly fixed to the outside of the launch tube at the bore for linearly moving the pin between an extended position in which its retaining end is extended within the launch cavity and a withdrawn position in which the retaining end is withdrawn from the launcher cavity so as to be substantially flush with the inside surface thereof;

biasing the pin to its extended position, the actuation of the actuable means moving the pin to is withdrawn position;

providing and actuating a load control switch;

generating in response to the actuation of the load control switch an electrical signal for actuating both of the actuable means for moving so as to effect the withdrawal of the pin to its withdrawn position allowing clear passage within the launch cavity for the loading of the rocket;

loading a rocket into said launching cavity;

actuating the load control switch so as to remove the electrical signal from the actuable means, permitting the pin to move in response to its bias to its extended position to engage said rocket;

receiving a firing command from an external source; and generating, in response to the firing command, a firing signal and coupling it to the firing contact, then, after a predetermined interval of time, actuating the mean for moving so as to withdraw the pin to is withdrawn position and to continue the application of a signal thereto so as to maintain the pin in its withdrawn position for a second predetermined interval of time, after which the pin returns to its respective extended position under the bottom of its means for biasing.

25. A rocket retention and ignition system, comprising:

at least two rocket launch tubes, each having a bore therethrough forming a launching cavity for receiving a rocket to be launched;

each of said launch tubes having (a) a retaining pin bore passing through the wall of said tube for receiving a linearly reciprocable rocket retaining pin and (b) a firing pin bore passing through the wall of said tube for receiving a linearly reciprocable firing pin;

a rocket retaining pin, associated with each launch tube, positioned so as to be linearly movable between a withdrawn position and an extended position within said retaining pin bore and being shaped at a retaining end thereof for engaging, when extended, a retaining groove formed in a rocket received within the launching cavity of said launch tube, the outside diameter of said retaining pin being of substantially the same size as the diameter of said retaining pin bore into which it is received, but sufficiently smaller in diameter than said retaining pin bore to allow for the linear displacement of said retaining pin within said retaining pin bore;

a rocket firing pin, associated with each launch to be positioned so as to be linearly movable between a withdrawn position and an extended position within said firing pin bore and having a firing contact at a firing end thereof for engaging, when extended, a firing contact of a rocket received within the launching cavity of said launch tube, the outside diameter of said firing pin being of substantially the same size as the diameter of said firing pin bore into which it is received, but sufficiently smaller in diameter than said firing pin bore to allow for the linear displacement of said firing pin within said firing pin bore;

means, associated with each launch tube, for moving said firing and retaining pins to either their respective extended positions for engaging respectively the rocket firing contact and retaining groove or to their respective withdrawn positions for respectively disengaging from a rocket being launched or for permitting the loading of a rocket into the launch tube; and means for conducting a rocket firing signal to said firing pin firing contact of each launch tube so as to fire a rocket therein.

26. A system according to claim 25 wherein said means for moving comprises first actuable means, rigidly fixed to the outside of said launch tube at said retaining pin bore, for linearly moving said retaining pin between an extended position in which said retaining end of said retaining pin is extended within said launch cavity and a withdrawn position in which said retaining end is withdrawn from said launcher cavity so as to be substantially flush with the inside surfaces thereof, and second actuable means, rigidly fixed to the outside of said launch tube at said firing pin bore for linearly moving said firing pin between an extended position in which said firing end of said firing pin is extended within said launch cavity and a withdrawn position in which said firing end is withdrawn from said launch cavity so as to be substantially flush with the inside surface thereof;

wherein said system further comprises means for biasing said retaining pin to its extended position, the actuation of said actuable means for moving siad retaining pin causing said retaining pin to move to its withdrawn position, and means for biasing said firing pin to its extended position, the actuation of said means for moving said firing pin causing said firing pin to move to its withdrawn position; and wherein said means for conducting a firing signal comprises a firing and control circuit including a load control switch and firing and load control means, coupled to said load control switch for receiving a load command therefrom and adapted to receiving a firing command from an external source, said load and firing control means providing (a) upon the application of a load command from said load control switch, an actuation of both first and second actuable means for moving so as to effect the withdrawal of said retaining pin and said firing pin to their respective withdrawn positions, allowing clear passage within said launch cavity for the loading of a rocket, (b) in response to a firing command, generating a firing signal and coupling it to said firing contact, then, after a predetermined interval of time, actuating both of said means for moving to simultaneously withdraw said retaining pin and said firing pin and to continue the application of said signal so as to maintain said pin in said withdrawn position for a second predetermined interval of time, after which said pins return to their respective extended positions under the action of their respective means for biasing.

27. A rocket retention and ignition system according to either claims 25 or 26 wherein said first and second actuable means comprise electrically actuable solenoids.

* * * * *